US006752745B1

(12) United States Patent
Davis

(10) Patent No.: US 6,752,745 B1
(45) Date of Patent: Jun. 22, 2004

(54) EXERCISE APPARATUS

(76) Inventor: Everton Davis, 6121 Glade Ave. B109, Woodland Hills, CA (US) 13287

( * ) Notice: Subject to any disclaimer, the term of this patent is extended or adjusted under 35 U.S.C. 154(b) by 55 days.

(21) Appl. No.: 10/270,205

(22) Filed: Oct. 11, 2002

(51) Int. Cl.[7] ..... A63B 21/00
(52) U.S. Cl. ..... 482/72; 482/129; 482/130
(58) Field of Search ..... 482/72, 129, 130, 482/133, 135, 137, 138, 121, 122, 123, 96; D21/690, 676

(56) References Cited

U.S. PATENT DOCUMENTS

D357,041 S * 4/1995 McBride et al. ..... D21/195
5,441,473 A 8/1995 Safani et al. ..... 482/130
5,722,917 A 3/1998 Olschansky et al. ..... 482/72
D396,509 S * 7/1998 Sands ..... D21/191
5,871,425 A 2/1999 Gvoich ..... 482/140
6,398,699 B1 * 6/2002 Yang ..... 482/142
6,533,710 B2 * 3/2003 Lin et al. ..... 482/123

* cited by examiner

*Primary Examiner*—Jerome W. Donnelly
(74) *Attorney, Agent, or Firm*—Goldstein Law Offices, P.C.

(57) ABSTRACT

An exercise apparatus utilized for toning and building muscles in different areas of the body, including the arms, chest, shoulders, abdominal muscles, thighs, calves, and hips. The exercise apparatus has a support assembly, having a horizontal bottom support bar, and various components positioned along the support bar. The components include a seat assembly located at the rear end, a pair of thigh press bars located at the middle portion, a foot support assembly located at the front end, and elastic bands. The elastic bands are attached between different movable parts of the apparatus in order to provide resistance to the user when attempting to move such movable parts with respect to each other while exercising.

12 Claims, 5 Drawing Sheets

EXERCISE APPARATUS

BACKGROUND OF THE INVENTION

The invention relates to an exercise apparatus. In particular, the invention is exercise equipment that enables a user to exercise almost every body part with the use of a single piece of equipment. The apparatus employs resistance training, through the use of tension bands, to strengthen and tone the user's muscles.

Exercising, coupled with the use of exercise apparatus, has become increasingly popular among men and women of all ages. Through regular and proper use of the exercise equipment, the individual can improve his or her muscle tone, strength and general fitness level.

Besides exercising to stay in shape and lose weight, people exercise to build muscles and relieve stress. Unfortunately, it is difficult to tone muscles without the use of weights or a means of resistance. Accordingly, people are limited as to where they can exercise to effectively tone their body areas and parts. Further, a different piece of equipment is typically needed for each body part. This usually forces a person to exercise at a gym or health spa since it is impractical for most people to have various pieces of exercise apparatus in their homes.

Thus, there exists a need for an exercise device that allows a user to tone and build muscles in various parts of the body with the use of a single piece of equipment. The device is intended to target different regions of the body, including arm, leg, abdominal, and back muscles, enabling a user to tone and build up muscles in these areas with a single apparatus.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved exercise apparatus. As such, the general purpose of the present invention, which will be described subsequently in greater detail, is to provide a new and improved exercise apparatus which has all the advantages of the prior art and none of the disadvantages.

To attain this, the present invention essentially comprises an exercise apparatus utilized for toning and building muscles in different areas of the body, including the arms, chest, shoulders, abdominal muscles, thighs, calves, and hips. The exercise apparatus has a support assembly, having a horizontal bottom support bar, and various components positioned along the support bar. The components include a seat assembly located at the rear end, a pair of thigh press bars located at the middle portion, a foot support assembly located at the front end, and elastic bands. The elastic bands are attached between different movable parts of the apparatus in order to provide resistance to the user when attempting to move such movable parts with respect to each other while exercising.

It is an object of the invention to produce an exercise apparatus that permits a user to perform several different exercises targeting different areas of the body using a single piece of equipment. Accordingly, the exercise apparatus has several components that are used to focus on different areas of the body.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
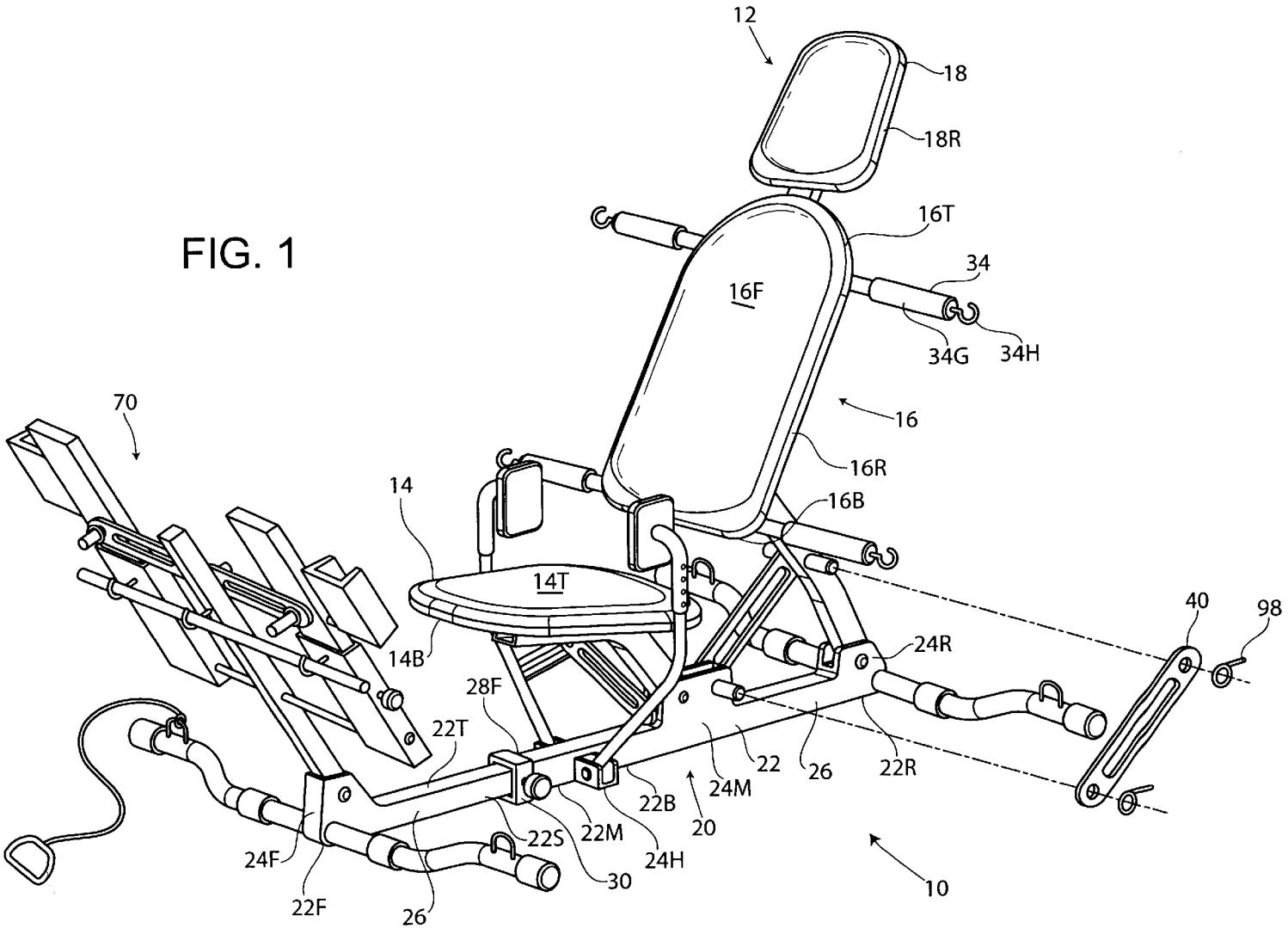
FIG. 1 is a perspective view of the exercise apparatus, illustrating one of the metal bands being secured in place to immobilize one of the components of the invention.

10 exercise apparatus
12 seat assembly
14 seat
14T seat padded top surface
14B seat bottom surface
16 back rest
16T back rest top
16B back rest bottom
16F back rest padded front surface
16R back rest rear surface
18 head rest
18F head rest padded front surface
18R head rest rear surface
20 support assembly
21 seat support
22 horizontal bottom support bar
22S bottom support bar side
22T bottom support bar top surface
22B bottom support bar bottom surface
22F bottom support bar front end
22R bottom support bar rear end
22M bottom support bar middle portion
24 bottom support bar sleeve
24F front sleeve
24R rear sleeve
24M middle sleeve
24H lateral sleeve
26 bottom support bar minor portion
28 bottom support bar major portion

28F bottom support bar major portion hollow front end
30 bottom support bar larger half ring
32 set screw
34 handlebar
34G handlebar grip
34H handlebar hook
40 elastic band
40E band end
40H band hole
50 back rest support
50E back rest support end
50M back rest support middle portion
60 peg
60A base peg
60B back rest peg
60C plate peg
60D stationary bar peg
60E thigh press peg
60F seat support peg
70 foot assembly
72 foot assembly stationary vertical bar
72F stationary bar front
72R stationary bar rear
74 adjustable plate
74T plate top portion
74B plate bottom portion
74F plate front side
74R plate rear side
75 push pin
76 foot pad
78 horizontal support rod
80 hook
82 stability bar
84 thigh press bar
84T thigh press bar top portion
84B thigh press bar bottom portion
84P thigh press bar pad
90 stabilizing leg
90E leg end
90R leg ring
92 leg rubber grip
94 rubber cord
94E rubber cord end
94H rubber cord handle
96 metal band
96E metal band end
96H metal band hole
98 locking ring

DETAILED DESCRIPTION OF THE PREFERRED EMBODIMENTS

FIG. 1 illustrates an exercise apparatus 10 utilized for toning and building muscles in different areas of the body, including the arms, chest, shoulders, abdominal muscles, thighs, calves, and hips. The exercise apparatus 10 essentially comprises a support assembly 20 having a horizontal bottom support bar 22 having a pair of sides 22S, a top surface 22T, a bottom surface 22B, a front end 22F, a rear end 22R, and a middle portion 22M positioned between the front and rear ends 22F, 22R. During ordinary use, the bar bottom support 22B rests on a flat ground surface, and the bar top surface 22T is oriented upwards. The apparatus 10 also comprises various components positioned along the support bar 22, including a seat assembly 12 located at the rear end 22R, a pair of thigh press bars 84 located at the middle portion 22M, foot support assembly 70 located at the front end 22F, and a plurality of elastic bands 40.

Figure 4:
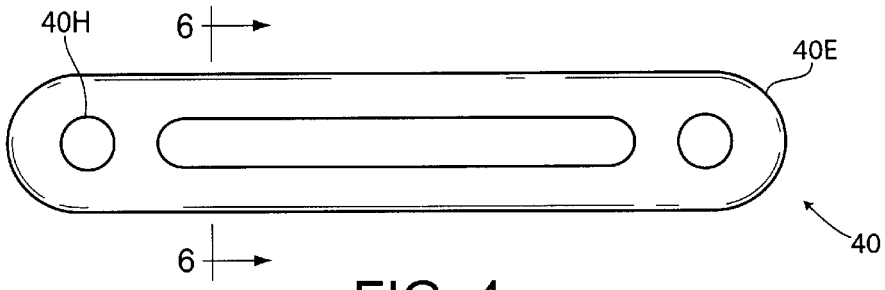
FIG. 4 is a top plan elevational view of one of the tensioned bands.
Figure 6:
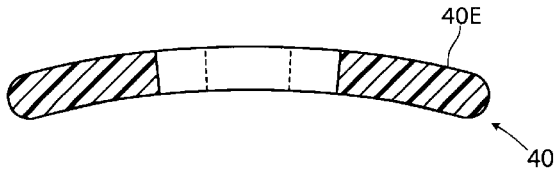
FIG. 6 is a cross sectional view of one of the tensioned bands taken along line 6 in FIG. 4.
Figure 7:
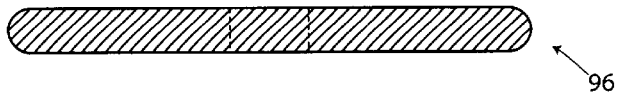
FIG. 7 is a cross sectional view of one of the metal bands taken along line 7 in FIG. 5.

The elastic bands 40 are attached between different movable parts of the apparatus 10 in order to provide resistance to the user when attempting to move such movable parts with respect to each other while exercising. The bands 40 preferably are constructed from a rigid rubber material that stretches when pulled upon, as illustrated in FIG. 6. The bands 40 are provided in different lengths according to the parts of the apparatus 10 between which they are to be used. Further, each band 40 has a pair of opposed ends 40E, each end 40E having a hole 40H therethrough, as illustrated in FIG. 4. The holes 40H are sized to accommodate pegs 60 of the apparatus 10, as will be described in greater detail hereinafter.

A plurality of sleeves 24 extend upward from the bar top surface 22T, namely a front sleeve 24F positioned at the bar front end 22F for attaching the foot assembly 70, a rear sleeve 24R positioned at the bar rear end 22R for attaching the back rest 16, and a middle sleeve 24M positioned at the bar middle portion 22M for attaching the seat 14. The middle sleeve 24 has a pair of base pegs 60A extending laterally therefrom. The base pegs 60 are sized to accommodate the band holes 40E for attachment therewith so that the bands 40 are anchored thereto. A set of lateral sleeves 24H are also positioned at the bar middle portion 22M along the sides of said bar 22 and extend outward therefrom. The sleeves 24 are sized to accommodate other parts of the apparatus 10 as will be described in greater detail hereinafter.

Further, the length of the bar 22 may be adjusted in order to accommodate users of different heights by adjusting the relative positions of the seat assembly 12 and foot assembly 70. In particular, the foot support assembly 70 may be brought closer or farther away from the seat assembly 12. In order to accomplish the above adjustability, the bar 22 is divided into two portions, namely a minor portion 26 and a major portion 28, wherein the minor portion 26 is sized to fit and telescope within the major portion 28 and the major portion 28 has a hollow front end 28F. Thus, when the two portions 26, 28 are mated, the hollow front end 28F of the major portion 28 accommodates the minor portion 26. A ring 30 is attached to the hollow front end 28F, said ring 30 having a set screw 32 extending therethrough for fixing the relative position of the major 28 and minor 26 portions. Thus, when the two portions 26, 28 are mated and the overall length of the apparatus 10 is properly adjusted, the set screw 32 is tightened against the minor portion 26, thereby securing the two portions 26, 28 of the bar together.

The seat assembly 12 comprises a seat 14, a back rest 16, and a head rest 18. The seat 14 has a padded top surface 14T on which the user sits or kneels according to the exercise being performed, and a bottom surface 14B that is supported by the support assembly 20, as will be described in greater detail hereinafter.

The support assembly 20 further comprises a back rest support 50 that extends upward from the bottom support bar rear sleeve 24R. The back rest support 50 has a pair of opposed ends 50E and a middle portion 50M therebetween. One of the support ends 50E is pivotally connected to the rear sleeve 24R, and the opposite end 50E is fixedly connected to the back rest rear surface 16R. Back rest pegs 60B extend perpendicular to the back rest support 50, said pegs 60B positioned at the back rest support middle portion 50M. One of the tensioned bands 40 is mated with one of the back rest pegs 60B at one end 40H and mated with one of the base pegs 60A at the opposite end 40H. When no pressure is applied against the back rest 16, the band 40 is maintained relatively untensioned in a resting position, and the back rest support 50 remains substantially perpendicular to the seat 14. Once pressure is applied against the back rest 16, the back rest support 50 moves rearward, thereby stretching the bands 40. The resistance of the bands 40 increases the effort required by the user and thereby exercises the user's muscles. The user may opt to kneel on the seat 14, hold onto one of the handlebar pairs 34 positioned on the back rest 16, and push backward. Alternatively, the user may sit on the seat 14, hold onto one of the handlebar pairs 34, and push backward.

A seat support 21 is attached to and extends upward from the middle sleeve 24M, and is also attached to the seat bottom surface 14B. The seat support 21 has a peg 60 positioned thereto for mating with one of the tensioned bands 40.

The back rest 16 extends upward from the support assembly 20, said back rest 16 having a top portion 16T, a bottom portion 16B, a padded front surface 16F for supporting the user's back or chest during exercising, and a rear surface 16R that is pivotally connected to the support assembly 20 for selectively pivoting the back rest 16 forward and backward. Lastly, the head rest 18 extends upward from the back rest top portion 16T, said head rest 18 being aligned with the back rest 16 to provide a continuous support for the user. The head rest 18 also has a padded front surface 18F and a rear surface 18R.

A pair of handlebars 34 extend outward from the back rest top portion 16T and the back rest bottom portion 16B. Each handlebar 34 has a grip 34G therearound and a hook 34H positioned opposite the back rest 16.

The foot assembly 70 is secured within the bottom support front sleeve 24F, and extends upward therefrom. The foot assembly 70 essentially comprises a vertical stationary bar 72, a pair of adjustable plates 74 positioned on either side of the bar 72 and pivotally connected thereto by a horizontal support rod 78, and a pair of foot pads 76 outwardly attached to the plates 74. The plates 74 each have a top portion 74T, a bottom portion 74B, a front side 74F, and a rear side 74R, wherein a plate peg 60C extends outward perpendicularly from the rear side 74R of each plate 74. The plate top portion 74T is telescopically attached within the plate bottom portion 74B, thereby allowing the length of the plate 74 to be adjustable. Each plate bottom portion 74B has a push pin 75 that is wedged against its associated plate top portion 74T, thereby securing said top portion 74T within the bottom portion 74B and fixing their relative positions. Further, the stationary bar 72 has a front side 72F and a rear side 72R. A stationary bar peg 60D extends rearwardly from the rear side 72R of the stationary bar 72. Thus, one end 40E of each of a pair of the tensioned bands 40 is attached to each plate peg 60C, attaches to the stationary bar peg 60D, and rests against the stationary bar front side 72F.

A stability bar 82 selectively connects the plates 74 by extending horizontally from one plate 74, across the stationary bar 72, to the second plate 74. Hooks 80 extending outward from the plate rear sides 74R and the bar rear side 72R support the stability bar 82. When the stability bar 82 is in place on the hooks 80, the plates 74 are ganged together and are limited to simultaneous movement. However, removal of the stability bar 82 allows the plates 74 to move independently of each other.

Figure 2:
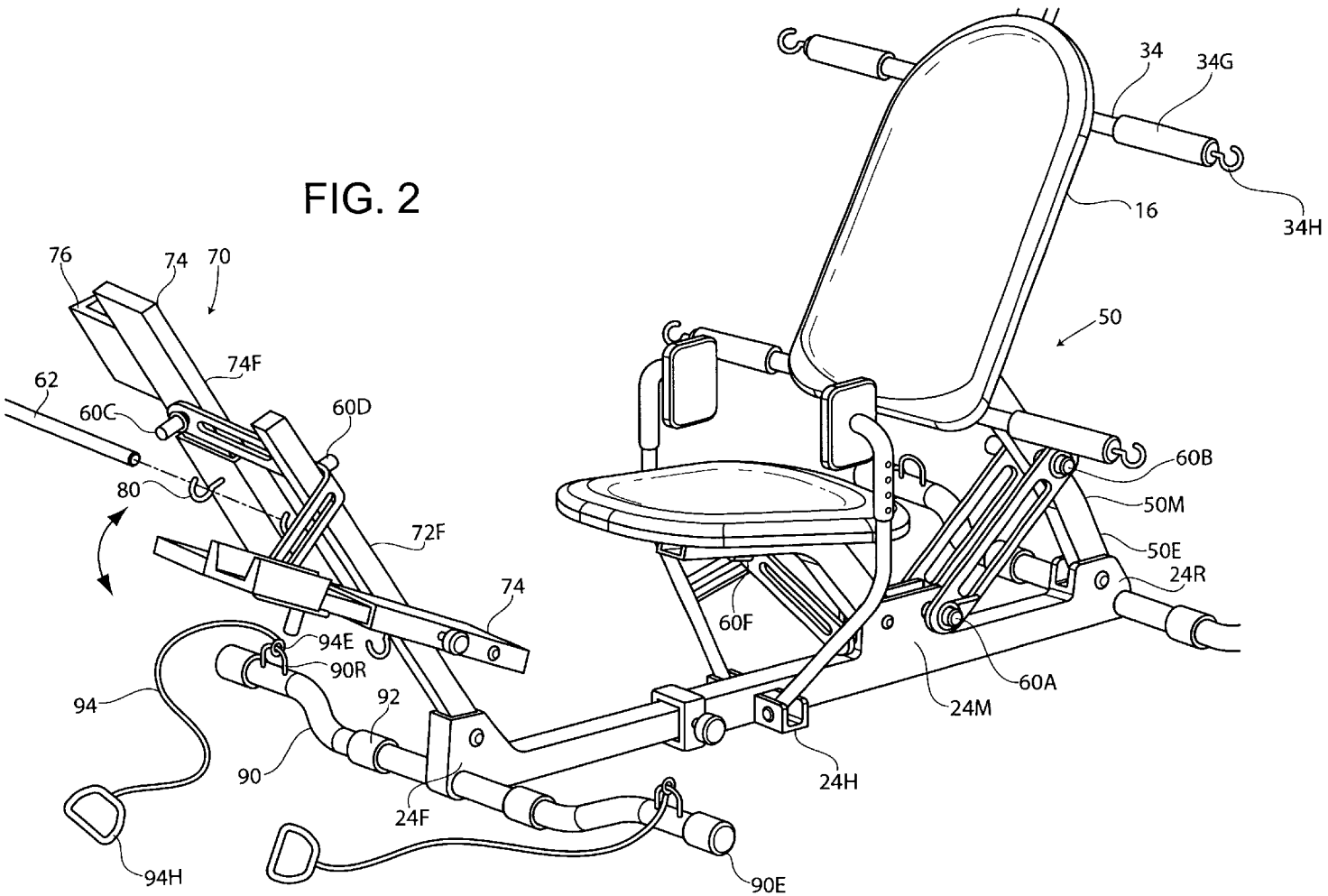
FIG. 2 is a perspective view of the exercise apparatus, illustrating removal of the stability bar and subsequent movement of one of the plates of the foot assembly.
Figure 3:
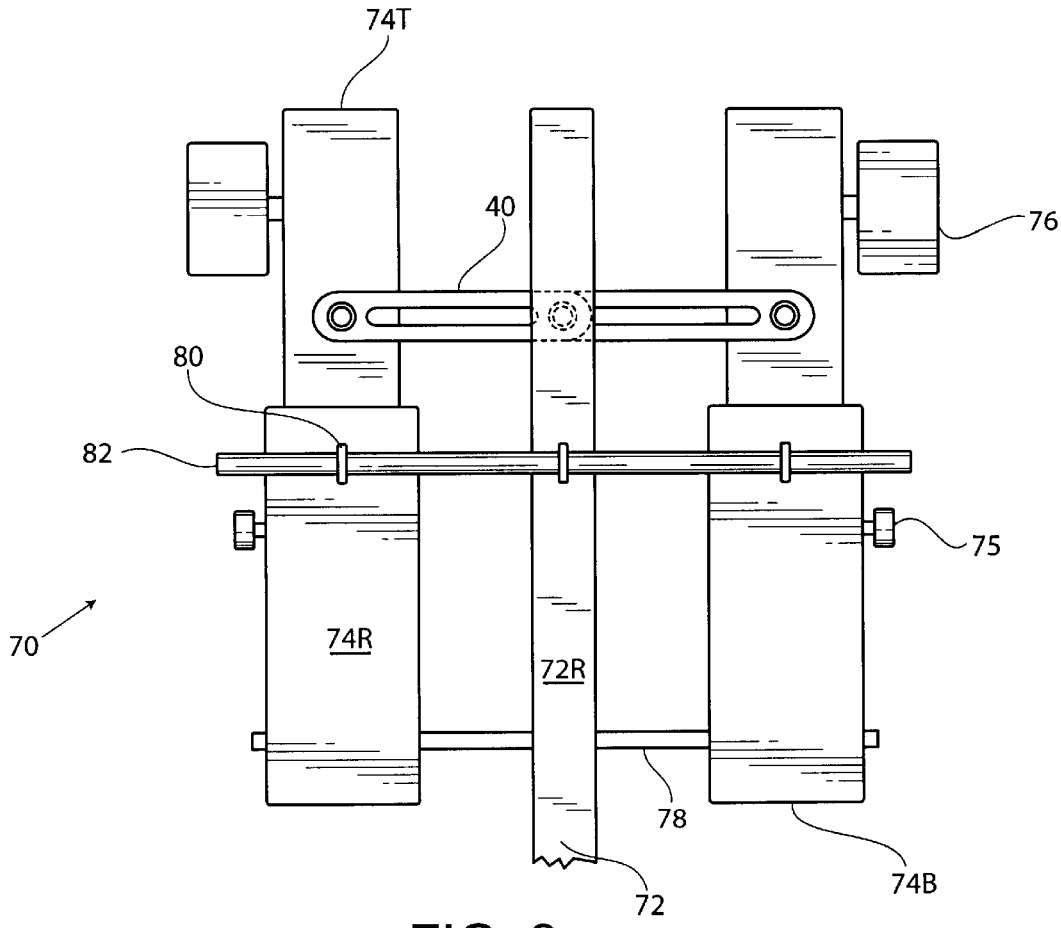
FIG. 3 is a rear elevational view of the foot assembly.

To use the foot assembly 70, the user sits on the seat 14 and places his or her feet against the foot pads 76. The user then presses his feet against the foot pads 76, either simultaneously or one foot at a time. Pressure against the foot pads 76 causes the plates 74 to pivot forward about the horizontal support rod 78 against the resistance of the bands 40 attached between the pegs 60C, 60D, as illustrated in FIG. 2.

The exercise apparatus 10 also comprises a pair of thigh press bars 84. The thigh press bars 84 extend upward from the bottom support horizontal sleeves 24H and are pivotally connected thereto so that they are capable of extending vertically alongside the seat 14 and pivoting laterally outward therefrom. The thigh press bars 84 each have a top portion 84T, a bottom portion 84B pivotally connected to one of the horizontal sleeves 24H, and a thigh press bar pad 84P attached to the top portion 84T. A thigh press peg 60E is attached near the bottom portion 84B of each thigh press bar 84. A pair of bands 40 connect the tight press bars 84 with the seat 14. Each of the bands 40 extends between one of the thigh press pegs 60E and the seat support peg 60F. Thus, in use, the user sits on the seat 14 with his or her thighs positioned adjacent to the thigh press bars 84. The user then pushes outward against the thigh press bars 84 and against the tension of the bands 40 secured thereto in order to work the thigh muscles.

Lastly, the exercise apparatus 10 comprises a pair of stabilizing legs 90 that extend outward from the bottom support front end 22F and the bottom support rear end 22R to stabilize the apparatus 10. The legs 90 each have rubber grips 92 that come into direct contact with the ground surface, thereby protecting the surface on which the apparatus 10 rests. Further, each leg 90 has an end 90E, said end 90E having a leg ring 90R attached thereto. Rubber cords 94 may be attached to the rings 90R and used by the user to perform other resistance exercises. The bands 94 each have a pair of opposed ends 94E, wherein one end 94 is secured to the leg ring 90R and the opposite end 94E has a handle 94H attached thereto. Once connected to the leg ring 90R, the user may perform a variety of different exercises by pulling the handles 94H away from the legs 90.

Figure 5:
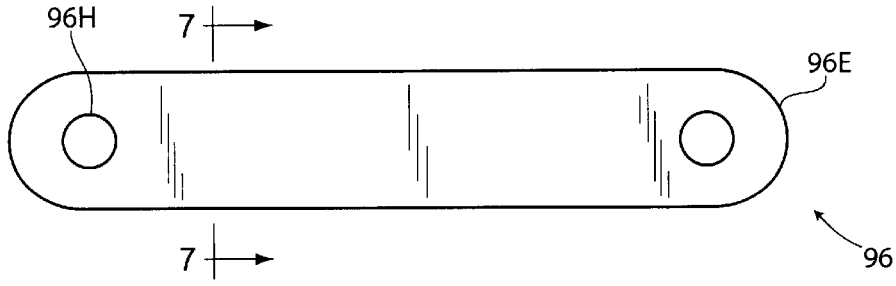
FIG. 5 is a top plan elevational view of one of the metal bands.
Figure 8:
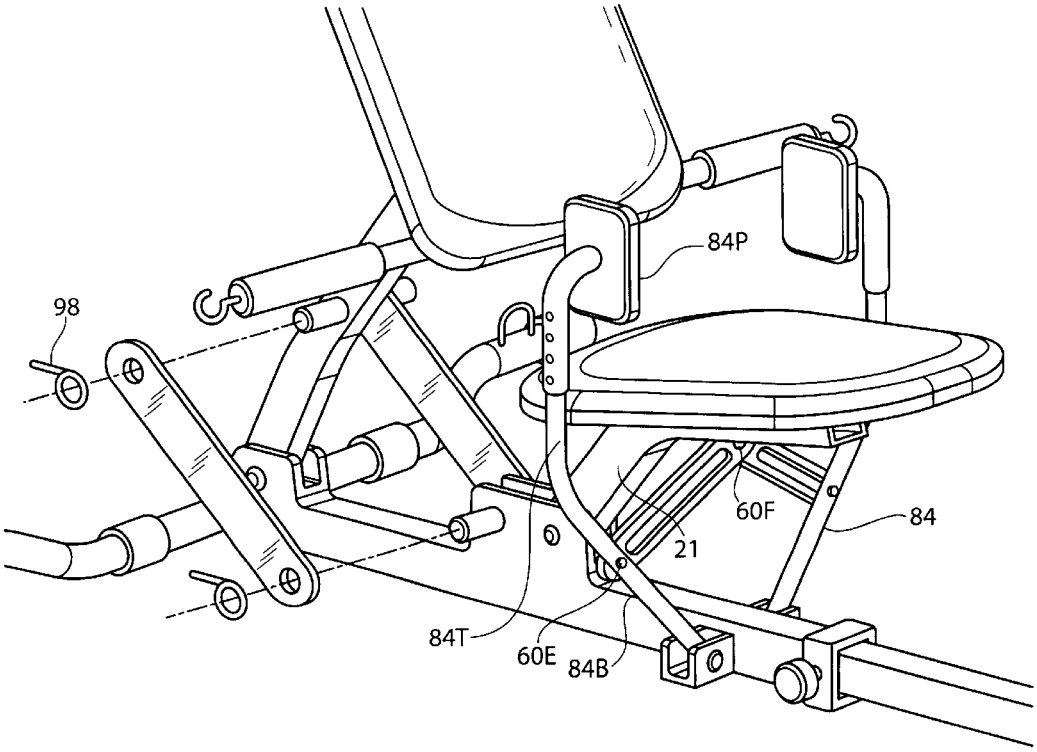
FIG. 8 is a perspective view of the rear end of the horizontal bottom support, illustrating positioning of one of the metal bands to immobilize the back rest.
Figure 9:
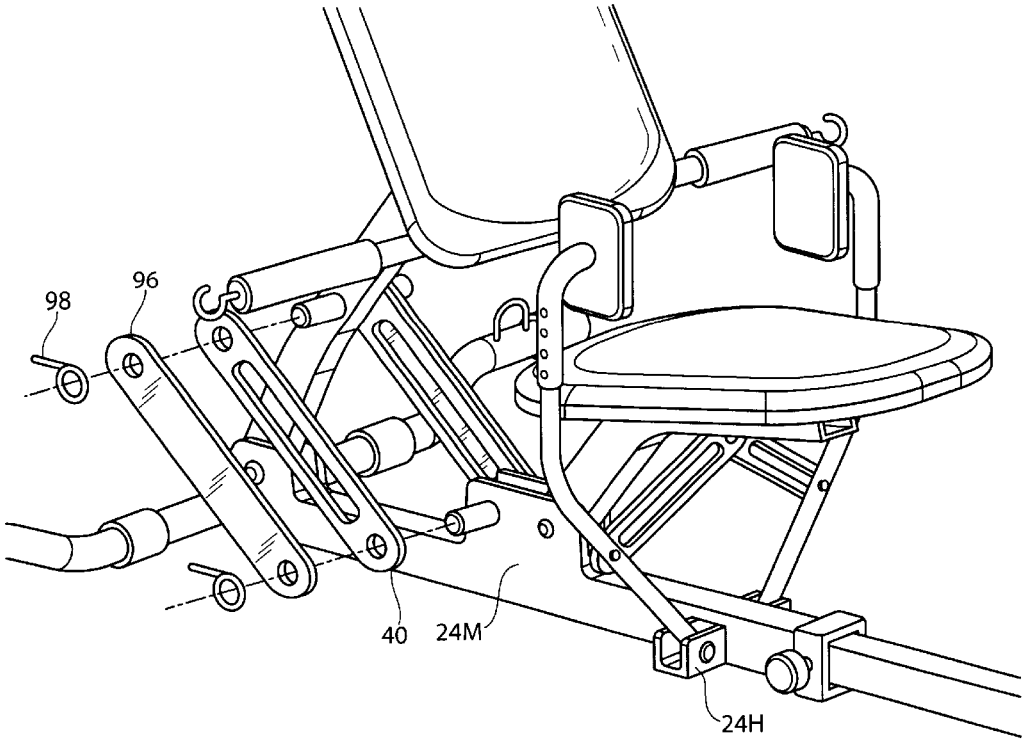
FIG. 9 is a perspective view of the rear end of the horizontal bottom support, illustrating the potential tandem positioning of one of the tensioned bands and one of the metal bands according to an embodiment of the present invention.

Metal bands 96 may also be employed with the apparatus 10, said bands 96 utilized in immobilizing one of the components of the said apparatus 10. Referring to FIG. 5, each metal band 96 has a pair of opposed ends 96E, each end 96E having a hole 96H extending therethrough for accommodating one of the pegs 60. The metal bands 96 are secured in place between a pair of pegs 60 in order to prevent movement of the corresponding components. By way of example, one of metal bands 96 may be secured between the back rest peg 60B and the base peg 60A in order to prevent movement of the back rest 16. Further, once the metal band holes 96 are mated with the corresponding pegs 60, locking rings 98 are positioned thereover to secure the metal band 96 in place, as illustrated in FIG. 8.

In conclusion, herein is presented an exercise apparatus that may be utilized to strength and tone different body areas and muscles. The invention is illustrated by example in the drawing figures, and throughout the written description. It should be understood that numerous variations are possible, while adhering to the inventive concept. Such variations are contemplated as being a part of the present invention.

What is claimed is:

1. An exercise apparatus for use by a user having feet, hands, and a body, comprising:

an apparatus support assembly, the support assembly comprising:

a horizontal bottom support bar that extends the entire length of the apparatus, the bottom support bar having a pair of sides, a top surface, a bottom surface, a front end, a rear end, and a middle portion positioned between the front and rear ends, the assembly further having a front sleeve positioned at the bar front end, a rear sleeve positioned at the bar rear end, a middle sleeve positioned at the bar middle portion;

a back rest support that extends upward from the bottom support bar rear sleeve, the back rest support having a pair of opposed ends and a middle portion therebetween, wherein one of the support ends is pivotally connected to the rear sleeve to allow the back rest support to pivot forward and rearward; and a seat support that extends upward from the middle sleeve; and a seat assembly, the seat assembly having a seat, a back rest, and a head rest, the seat having a top surface and a bottom surface supported by and attached to the support assembly seat support, the back rest having a top portion, a bottom portion, a padded front surface, and a rear surface which is connected to the back rest support, and wherein the head rest extends upward from the back rest top portion;

a foot support assembly that is pivotally secured within the bottom support front sleeve and extending upward therefrom, the foot assembly having a vertical stationary bar, a pair of adjustable plates positioned on either side of the vertical stationary bar and pivotally connected thereto by a horizontal support rod, and a pair of foot pads attached outwardly to the plates for accommodating the user's feet, wherein each plate has a front side and a rear side, and the stationary bar has a front side and a rear side;

a plurality of elastic bands, the bands being attached between the back rest and base, and between the vertical stationary bar and plates to provide resistance to the user during exercise, said bands having a pair of opposed ends, each end having a hole therethrough for attaching to one of the back rest, base, vertical stationary bars, and plates; and wherein the foot assembly further comprises hooks attached to the rear sides of the plates and a stability bar for selectively connecting the plates by mating with the hooks of both plates, whereby when the stability bar is engaged with the hooks the plates are limited to simultaneous movement, and when the stability bar is removed, the plates are allowed to moved independently of each other.

2. The exercise apparatus as recited in claim 1, wherein the support assembly further comprises a set of horizontal sleeves positioned at the bar middle portion along the sides, said sleeves extending laterally outward therefrom; and wherein the apparatus further comprises a pair of thigh press bars, the thigh press bars each having a top portion, a bottom portion, and a pad attached to the top portion, the thigh press bar bottom portion pivotally connected to the bottom support horizontal sleeves for allowing lateral movement of the thigh pres bars, the thigh press bars extend upward alongside the seat; and wherein elastic bands extend between each of the thigh press bars and the seat bottom surface to resist outward movement by the thigh press bars.

3. The exercise apparatus as recited in claim 1, wherein the plates each having a top portion and a bottom portion, whereby the plate top portion extends telescopically into the plate bottom portion thereby allowing the length of the plate to be adjustable.

4. The exercise apparatus as recited in claim 3, wherein each plate bottom portion further comprises a push pin that is wedged against the plate top portion, thereby securing said top portion within the bottom portion.

5. The exercise apparatus as recited in claim 1, wherein the horizontal bottom support bar includes a major portion and a minor portion, wherein the major portion has an open front end for telescopically accommodating the minor portion, whereby the overall length of the horizontal support bar may be adjusted in order to accommodate different users.

6. The exercise apparatus as recited in claim 5, wherein the horizontal bottom support bar major portion further comprises a ring extending around the open front end and a set screw extending through the ring and the bar major portion, whereby the set screw tightens against the minor portion to fix relative positions of the major and minor portions.

7. The exercise apparatus as recited in claim 6, further comprising a pair of stabilizing legs, one of the legs extending laterally outward from the bottom support front end and the other leg extends laterally outward from the bottom support rear end.

8. The exercise apparatus as recited in claim 7, wherein each stabilizing leg has at least one leg ring and wherein the apparatus further comprises rubber cords that are selectively attachable to the leg rings, each rubber cord having a pair of opposed ends, wherein one end is securable to the leg ring and the opposite end has a handle attached thereto for tensioning the cord against said leg ring.

9. The exercise apparatus as recited in claim 1, wherein the seat assembly further comprises a pair of handlebars that are attached to and extend laterally outward from the back rest top portion and the back rest bottom portion, each handlebar having a grip therearound.

10. The exercise apparatus as recited in claim 9, wherein each handlebar has a hook positioned adjacent to its grips.

11. The exercise apparatus as recited in claim 1, wherein the apparatus further comprises metal bands utilized in immobilizing one of the components of the apparatus, each band having a pair of opposed ends, and each end having a hole extending therethrough for accommodating one of the pegs.

12. The exercise apparatus as recited in claim 11, wherein the apparatus further comprises locking rings, the locking rings being positioned over the metal band and the peg in order to secure the metal band in place.

* * * * *